US005457597A

United States Patent [19]

Rothschild

[11] Patent Number: 5,457,597

[45] Date of Patent: Oct. 10, 1995

[54] ELECTRICAL SHOCKING APPARATUS

[76] Inventor: Zane Rothschild, 906 N. Doheny Dr., #315, Los Angeles, Calif. 90069

[21] Appl. No.: 105,608

[22] Filed: Aug. 12, 1993

[51] Int. Cl.[6] ..... F41B 15/04

[52] U.S. Cl. ..... 361/232; 42/1.08; 89/1.11

[58] Field of Search ..... 361/225, 226, 361/230, 231, 232, 235, 191; 89/1.4, 1.11; 42/1.08, 70.01

[56] References Cited

U.S. PATENT DOCUMENTS

| | | | |
|---|---|---|---|
| 2,805,067 | 9/1957 | Ryan . | |
| 3,484,665 | 12/1969 | Mountjoy et al. | 361/232 |
| 3,803,067 | 4/1973 | Cover . | |
| 3,998,459 | 12/1976 | Henderson et al. | 361/232 |
| 4,162,515 | 7/1979 | Henderson et al. | 361/232 |
| 4,253,132 | 2/1981 | Cover | 361/232 |
| 4,486,807 | 12/1984 | Yanez | 361/232 |
| 5,282,332 | 1/1994 | Philips | 42/1.08 |

OTHER PUBLICATIONS

The Nova Telescopic Electronic Restraint Staff (Model TERS-8 and TERS-4 by Nova Technologies, Inc.), 1992.

*Primary Examiner*—Jeffrey A. Gaffin

*Attorney, Agent, or Firm*—Jeffrey G. Sheldon; Sheldon & Mak, Inc.

[57] ABSTRACT

Electrical shocking apparatus includes an electrical conductive means having an outer face which can be selectively electrically energized. There is an elongated housing attached to the electrical conductive means. The elongated housing extends for at least about twice as long as the electrical conductive means. The conductive means includes a series of spaced arms radiating from the center to which the elongated housing is also connected with the conductive means. The housing has insulation means so that it is isolated from the conductive means. The conductive means with multiple radiating arms can be used as a physical prod, a physical hook and also to impart electrical shock to a person in contact with a conductive means. This can subdue and immobilize for arrest or defense. The arms are mounted so that sparking is effected between the conductive means and across the arms.

21 Claims, 3 Drawing Sheets

ELECTRICAL SHOCKING APPARATUS

BACKGROUND

An electrical shocking apparatus for effectively stunning unruly persons is highly desirable.

This invention relates to shocking apparatus. In particular the invention is concerned with a stun gun for controlling unruly persons. More particularly the invention relates to such a gun which exhibits audible and visible sparks.

Stun guns for controlling crowds or individuals who are unruly are known. These are in the nature of an elongated extended arm which is held in the hand and can be used by police as required. A handle is nonconductive and the arm is conductive so as to be able to impart an electrical shock without harming the user.

Such guns are limited in their uses. They are relatively compact in size or have to be held close to the user to insure ease of manipulation. Unruly persons can thereby often physically assault the user before the user can effectively use the stun gun.

This invention is directed to minimizing the disadvantages of known stun guns.

SUMMARY

This invention seeks to minimize the disadvantages of known stun guns.

According to the invention, electric shocking apparatus comprises electrical conductive means including an outer face which is selectively electrically energized. In operative condition the conductive means is capable of imparting an electric shock to a person coming into contact with the outer face. There is an elongated housing having electrical insulation means. The housing is electrically isolated from the conductive means so that it can be used as a handle.

The conductive means includes respectively multiple radially spaced apart arms. The arms form a plane and the elongated housing lies in the plane. At least some of the arms are directed rearwardly such that together with a portion of the elongated housing they form a physical hook type device. In this manner the shocking apparatus can be used both to shock and also as a physical hook to pull, for instance, the leg of an unruly person. The arms extending forward can also be used for prodding.

The elongated housing is at least two to three times as long as the effective length of the arms. The effective length is the distance between the point of the arm closest to the handle and the furthest point of the arm and directly forwardly from the handle.

The elongated housing and the arms are at least partly hollow. The elongated housing contains electrical circuitry to generate the sparking within the arms. The arms serves as support members for a conductive element such that the sparking occurs about the arms. The sparking is also audible. Sparking can occur internally within the arms and/or externally outside the arms.

Optionally, an extension pole can be removably affixed with the elongated housing thereby to further remove the arms from a location of the device which is to be used as a handle by the user.

The invention is further described with reference to the accompanying drawings.

DRAWINGS

Figure 1:
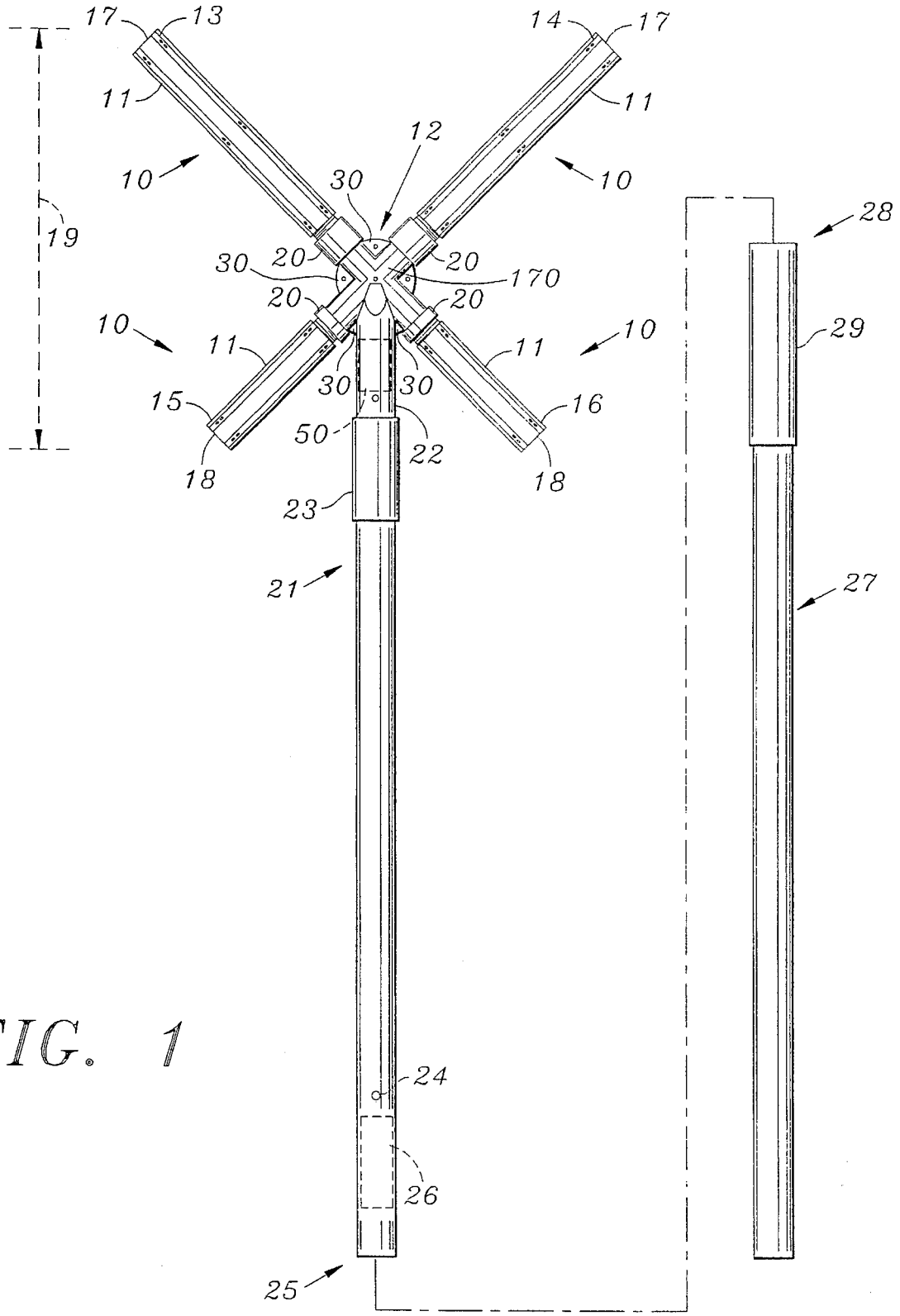

FIG. 1 is a side view of the device.

Figure 2A:
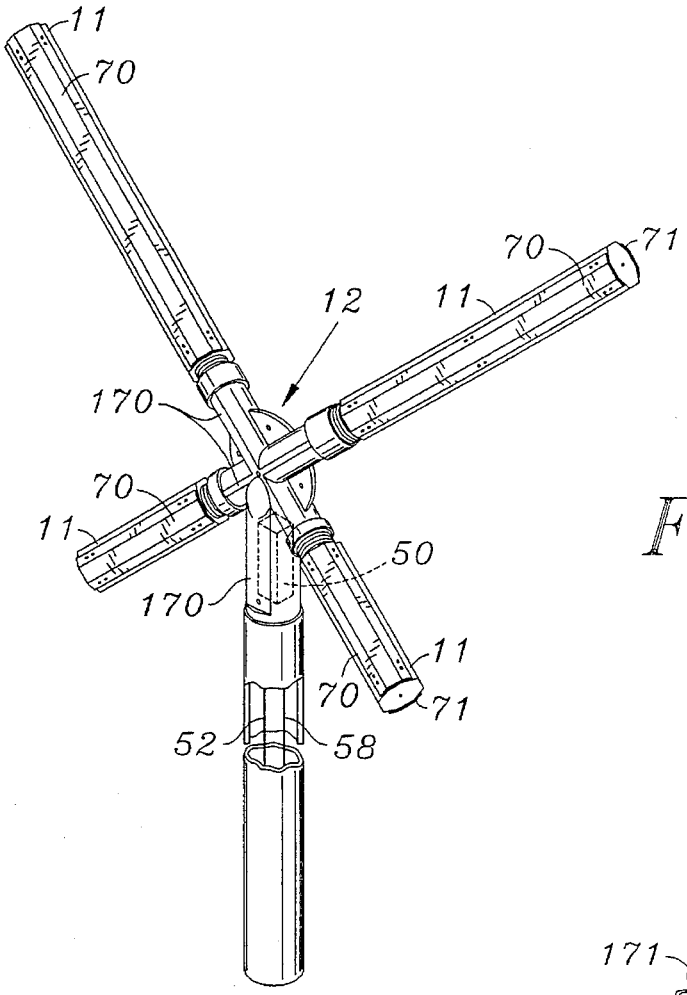

FIG. 2*a* is a partial perspective view with parts broken away.

Figure 2B:
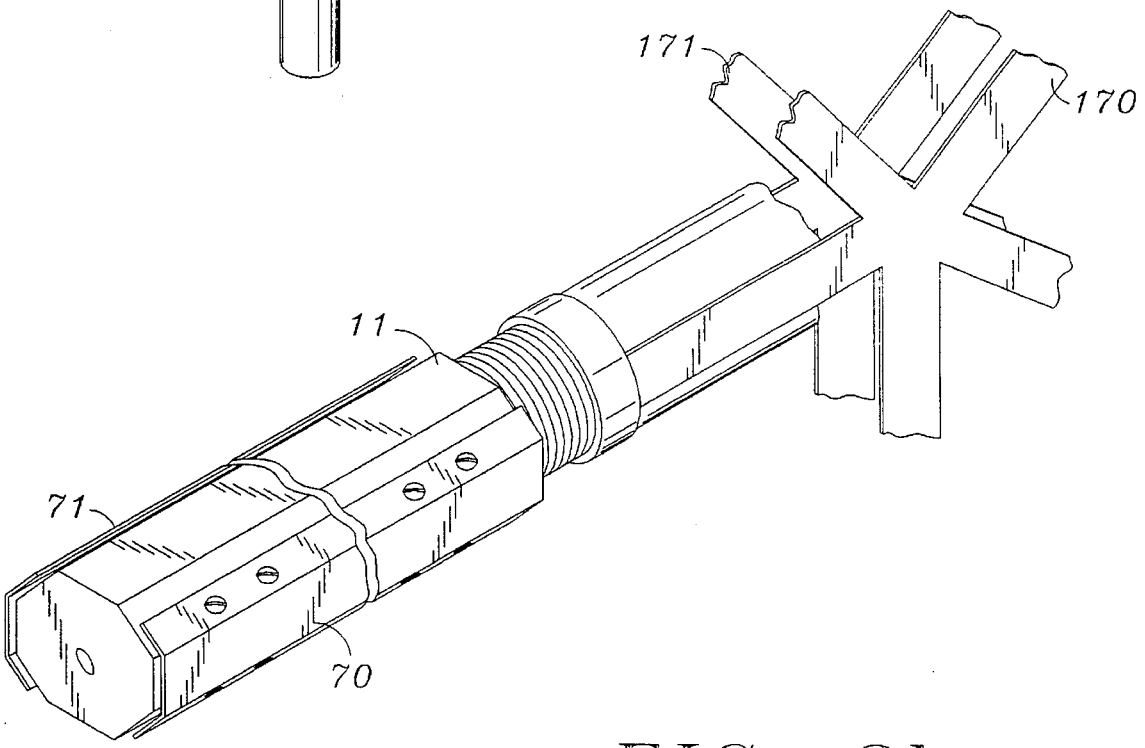

FIG. 2*b* is a partial perspective view of the inside of an arm.

Figure 3:
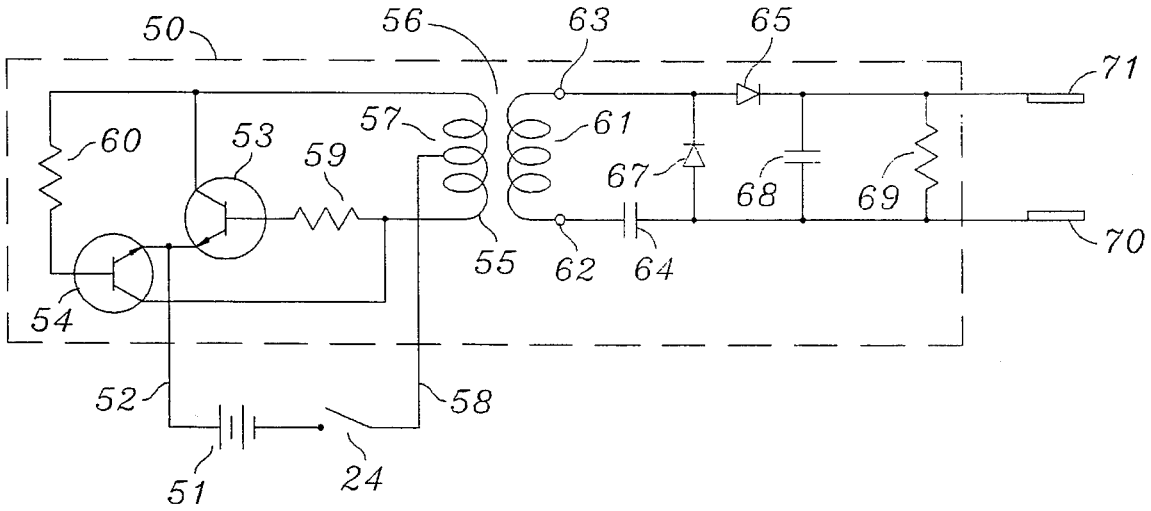

FIG. 3 is a representative electrical circuit.

DESCRIPTION

An electrical shocking apparatus comprises electrical conductive means 10 which includes an outer face 11. The outer face 11 can be selectively electrically energized whereby in operative condition, the conductive means 10 is capable of imparting an electric shock to a person coming into contact with the outer face 11.

The conductive means 10 is in the form of four arms radiating from a central connection 12 to form a cross. The arms are directed at about ninety degrees relative to each other and form a relatively flat plane. Two of the arms, namely the arm 13 and arm 14, are relatively forwardly directed and arms 15 and 16 are relatively rearwardly directed. Between the tips 17 of arms 13 and 14 and the tips 18 of the rearward arms 15 and 16 there is an effective elongated length 19.

The forward arms 13 and 14 are about 12" in length from the central connection position 12. The tips 17 and 18 are spaced apart about 18". The rearward arms 15 and 16 are shorter, namely about 6" in length. The arms screw connect with the threaded portion female connectors 20 which radiate from the central connector 12. Alternatively, the arms 13, 14, 15 and 16 can be bayonet connected to the female connectors 20.

There is an elongated housing 21 which is affixed to an extension 22, which also radiates from the central connector zone 12. The extension 22 is located between the connector 20 for arms 15 and 16. At the end of extension 22 there is a connection 23 for connecting with the elongated arm 21. This connection 23 can be a thread connected fitting or bayonet fitting or permanent attachment with the leading end of the elongated housing 21.

The elongated housing 21 is relatively hollow and includes wiring to a trigger 24 located towards the end 25 of the elongated housing 21. There is also a battery compartment 26 within the housing 21 in a location towards the end 25.

The overall length between the end 25 and the tips 17 and 18 is about 4'. An extension pole 27 is available for further extending the length of the elongated housing a further 3'. At the forward end 28 of PATENT the extension 27 there is a positive attachment means 29 for bayonet connecting with the end 25 or for screw connecting with the end 25 as necessary. In this manner, the electrical shocking apparatus can have a elongated housing which is at least two and preferably at least three times as long as the effective length 19 of the conductive means.

The central connective portion 12 includes reinforcing webs 30 between each of the female connective portions 20 and the extension section 22. This provides for sufficient mechanical rigidity for the device. Within the extension 22 there is housed an electrical circuit to generate the power to electrically energize the conductive elements on arms 13, 14, 15 and 16.

Each of the arms 13, 14, 15 and 16 is formed on substantially translucent hollow non-conductive member 11. A pair of spaced conductive elements 70 and 71 are located over of the arms 13, 14, 15 and 16 and are electrodes. The elements 70 and 71 are energized by an electrical circuit 50. The conductive elements 70 and 71 act as spark gap electrodes. The conductive elements 70 and 71 are connected to the electric circuit 50 by physical connection through the screw connectors 20 and the plates 170 and 171 mounted to either side of the central connective support 12.

The conductive elements 70 and 71 are mounted on a suitable partly translucent blackened material which constitute arms 13, 14, 15 and 16. The elongated extension 21, pole 23 and the central connector 12 are constructed from any suitable material such as graphite, aluminum, Kevlar™, PVC or the like. The hollow elongated translucent members for arms 13, 14, 15 and 16 are PVC, Kevlar™ or the like.

Electronic Sparking Circuit

A representative electrical circuit 50 for imparting the electrical shocking to a person coming in contact with elements 70 and 71 are described. The electronic circuit 50 is powered with batteries 51 which are housed in the battery compartment 26 near the end 25. A trigger switch 24 is housed adjacent the battery compartment 26.

The batteries 51 are connected through the conductor 52 across the emitters of a pair of transistors 53 and 54. These are connected directly to one terminal of the batteries 51. The collectors of the transistors 53 and 54 are connected to opposite ends of a primary winding 55 of a transformer 56. A center tap 57 to the transformer 56 is connected through conductor 58 and trigger switch 24 to the opposite end of the batteries 51.

The base of transistor 53 is connected through resister 59 to the collector of transistor 54. The base of transistor 54 is connected through resistor 60 with the collector of transistor 53. The two transistors 53 and 54 act as a free running, multi-vibrator which is activated by the closing of the trigger 24.

The transformer 56 has a secondary winding 61 with a terminal 62 which is connected to a series connected capacitor 64. Terminal 63 is connected through a diode 65 to a spark gap electrodes 70–71. The cathode of the diode 65 is connected to one terminal of the spark gap electrodes 70–71. A second diode 67 is connected between the anode of the diode 65 land the other terminal of capacitor 64. A charge capacitor 68 is connected between the cathode of diode 65 and the anode of diode 67.

A bleeder resistor 69 is connected in parallel with the charge capacitor 68 to assure that high voltage charge is not stored in the capacitor 68 for any appreciable time. The capacitor 64 and diode 67 form a voltage multiplier stage which with a diode 65 and the charge capacitor 68 produces a direct voltage output to the electrodes 70 and 71.

The batteries 51 are two 9 volt alkaline units, which can be rechargeable. The transistors 53 and 54 are suitable power transistors. The wiring 52 and 58 extends from the connector portion 22 through the hollow elongated housing 21 to the trigger 24 and battery compartment 26. The outer elements 70 on the member 11 and the conductor element 71 at the end of arms 13, 14, 15 and 16 forms the respective electrodes 70 and 71.

The electronic design is based on a transistorized relaxation oscillator which periodically, 5 to 25 times per second, transfers an electrical charge accumulated on a small timing capacitor into the primary winding 57 of a high ratio step-up transformer 56. The electrical parameters and operating conditions of the circuit are chosen so that the voltage on the secondary winding 61 exceeds the dielectric breakdown potential of the air gap between electrodes 70 and 71. This results in a distinctive succession of brief discharge arcs. These arcs occur with auditory and visual characteristics. The output is about 0.4347 milliamps with a time course and pulse length of about 1 millisecond.

This circuitry is conceptually similar to an automobile ignition system. The circuit parameters are altered to achieve a more psychologically and physiologically effective discharge while maintaining non-lethality. The use of a commercial spark gap prevents erosion and failure if used for extended periods of time.

The device has a low peak potential of at least about 50,000V. This can be enhanced by having two output transformers, two batteries, and a larger storage capacitor (0.66 μf). These factors, along with resonance augmentation tailor the output on terminals 70 and 71 to support multiple nearly simultaneous discharges occurring between terminals 70 and 71 randomly along the length of the outer faces 11. Two output transformers 56 would have their secondary windings connected in series. This circuit optimizes the incapacitation ability.

Resonance augmentation is used to substantially enhance both the snapping sound emitted by the arcing as well as the brilliance of the arc itself. This enhancement occurs as the result of a high voltage capacitor 68 inserted across the output of the step up transformer 56. It is physically formed so as to reside unobtrusively in the head of the device. Resonance augmentation tunes the output transformer 56 to resonate at the frequency of the principal sinusoidal components of the output pulses.

The higher output voltage and higher pulse is a result of three components:

(1) Larger storage capacitor, (2) Larger battery supply, and (3) Resonance augmentation.

Operation of Device

When the sparking apparatus is used as a stun gun, the operator energizes the conductive element by operating the trigger 24. The outer faces 70 and 71 become conductive and if contact is made to elements 70, 71, 170 or 171 by a person a shock will be imparted. Also between the elements 70 and 71 there is a sparking action. As the sparking is at high voltage, about 50kV–120kV, the sparking is also audible.

One or more of the arms can be used to physically prod or hook a person. When the rear arms 15 and 16 are used together with extension 22 or extendable housing 21 there can be a hooking action. The forward arms 13 and 14 can be used for prodding. It can be used to subdue and arrest and unruly law breaker and to defend against an unruly person with a weapon in their hand.

The device is an electrically active repelling device whose benefit is the ability to repulse or subdue an aggressor or mob at more than arms length. This improves operator safety and effectiveness in successfully coping with and subduing such dangerous situations. The invention is often used to subdue and arrest an unruly person or defend against an armed, unruly person.

A primary repulsive and intimidating feature of the device is a multiplicity of electric discharges from the X-shaped arms located at the end of a long tube 21. The physical characteristics of the structure, while the electric discharges have a commanding sight and sound. The arc discharge elements are located in the ends of the arms and are paired resulting in two nearly simultaneous large arcs for instance in arms 13 and 14 on either side of the device.

GENERAL

Many other forms of the invention exist each differing from others in matters of detail only. For instance, there may be two arms, three arms or more for constituting the basis for the conductive means. Instead of being in one plane the arms may radiate in different planes. When, in a single plane, this plane can be different to the plane of the elongated housing. Also, the degree to which the arms 13, 14, 15 and 16 are electrified can vary. All or part of the length of the arms may be electrified on the outer face 11. The outer face of the central connector 12 may or may not be electrified. The electrical output characteristics can be changed as described. The arms 13, 14, 15, and 16 are selectively removable from the elongated housing.

The invention is to be determined solely by the following claims.

I claim:

1. An electrical shocking apparatus comprising:

(a) an elongated, insulated housing useful as a handle;

(b) electrical conductor means connected to one end of the housing, the conductor means comprising:

(i) central connector means;

(ii) at least two arms emanating radially from the central connector, the arms having a peripheral surface;

(iii) at least one conductive element on the peripheral surface of each arm along the length of each arm; and (c) an electrical circuit for selectively energizing the conductive elements so that the peripheral surface of the arms can impart an electrical shock to a person coming in contact with the surface of the arms.

2. The apparatus of claim 1 wherein at least one arm extends forwardly for prodding a person, and at least one arm is directed rearwardly in a direction set off from the line defined by the elongated housing thereby forming with the elongated housing a hook type device for hooking a person.

3. Apparatus as claimed in claim 2 wherein the rearwardly directed arm is relatively shorter than the forwardly extending arm.

4. The apparatus of claim 1 wherein the conductors are elongated and extend along substantially the entire length of each arm for charging substantially the entire peripheral surface of the arms.

5. The apparatus of claim 4 wherein there are a pair of spaced conductors on the peripheral surface of each arm.

6. Apparatus as claimed in claim 1 wherein the conductive means extends over an effective elongated length, and wherein the elongated housing is at least about as long as the effective length of the conductive means.

7. Apparatus as claimed in claim 6 wherein the elongated housing is about twice as long as the effective length.

8. Apparatus as claimed in claim 6 wherein the elongated housing is at least about three times as long as the effective length.

9. Apparatus as claimed in claim 1 wherein the arms define a plane, and wherein the elongated housing lies in the plane.

10. Apparatus as claimed in claim 1 including an extension means affixable to the elongated housing thereby to further extend the elongated housing.

11. Apparatus as claimed in claim 1 including reinforcement means about the central connector between the arms thereby to secure the arms.

12. Apparatus as claimed in claim 1 wherein the arms are selectively removable from the elongated housing.

13. Apparatus as claimed in claim 1 wherein the elongated housing and arms are at least partly hollow.

14. Apparatus as claimed in 1 wherein the electrical circuit, when it energizes the conductive elements causes sparking about the arms.

15. Apparatus as claimed in claim 14 wherein the sparking is audible.

16. Apparatus as claimed in claim 14 wherein the electrical circuit includes batteries, and the elongated housing contains the batteries.

17. Apparatus as claimed in claim 1 wherein the arms radiate to form a cross configuration defining a plane, the elongated housing lying in the plane.

18. An electrical shocking apparatus comprising:

(a) an elongated, insulated housing useful as a handle;

(b) electrical conductor means connected to one end of the housing, the conductor means comprising:

(i) a central connector;

(ii) four arms emanating radially from the central connector in an X-shape and defining a plane with the elongated housing lying in the plane, two arms extending forwardly for prodding a person, and two arms directed rearwardly in a direction set off from the line defined by the elongated housing thereby forming with the elongated housing a hook type device for hooking a person, the arms having a peripheral surface;

(iii) at least one conductive element on the peripheral surface of each arm along the length of each arm; and (c) an electrical circuit for selectively energizing the conductive elements so that substantially the entire peripheral surface of each arm can impart an electrical shock to a person coming in contact with the arm surfaces.

19. The apparatus of claim 18 wherein the conductive means extends over an effective length and the housing is at least about three time as long as the effective length.

20. The apparatus of claim 18 wherein the conductors are elongated and extend along substantially the entire length of each arm for charging substantially the entire peripheral surface of the arms.

21. The apparatus of claim 20 wherein there are a pair of spaced conductors on the peripheral surface of each arm.

* * * * *